US006770429B2

(12) United States Patent
Duan

(10) Patent No.: US 6,770,429 B2
(45) Date of Patent: Aug. 3, 2004

(54) SINGLE PART COLOR PHOTOGRAPHIC DEVELOPER CONCENTRATE

(75) Inventor: Hailing Duan, Montville, NJ (US)

(73) Assignee: Fuji Hunt Photographic Chemicals, Inc., Allendale, NJ (US)

( * ) Notice: Subject to any disclaimer, the term of this patent is extended or adjusted under 35 U.S.C. 154(b) by 0 days.

(21) Appl. No.: 09/957,355

(22) Filed: Sep. 21, 2001

(65) Prior Publication Data

US 2002/0061475 A1 May 23, 2002

Related U.S. Application Data

(60) Provisional application No. 60/234,305, filed on Sep. 21, 2000.

(51) Int. Cl.[7] ..... G03C 7/407; G03C 7/413

(52) U.S. Cl. ..... 430/466; 430/486; 430/493

(58) Field of Search ..... 430/466, 486, 430/493

(56) References Cited

U.S. PATENT DOCUMENTS 5,021,326 A * 6/1991 Meckl et al. ..... 430/399
6,077,651 A * 6/2000 Darmon et al. ..... 430/466
6,159,670 A * 12/2000 Buongiorne et al. ..... 430/491
6,251,573 B1 * 6/2001 Tappe et al. ..... 430/466

* cited by examiner

*Primary Examiner*—Hoa Van Le
(74) *Attorney, Agent, or Firm*—Burns, Doane, Swecker & Mathis, L.L.P.

(57) ABSTRACT

A single-part, single-phase liquid color developer concentrate for color photographic development having at least one color developing agent of p-phenylenediamine or a derivative or salt thereof, an aqueous solution containing one or more organic solvents in a weight ratio of water to the organic solvent greater than or equal to about 60:40, a molar ratio of $[Na^+]/[K^+]$ of at least about 1:2, preferably at least about 2:1, and/or a molar ratio of the organic solvent of Formula (I) to a free base of the p-phenylendiamine or p-phenylendiamine derivative is from about 3:1 to about 30:1 is described. The color developer concentrate is simple to manufacture, stable, compact, easy to use, has good water solubility upon dilution, minimizes mixing errors, and can be used with a very low replenishment rate. A method for processing image-wise exposed photographic color silver halide emulsions using the single-part, single-phase liquid color developer concentrate is also provided.

25 Claims, No Drawings

SINGLE PART COLOR PHOTOGRAPHIC DEVELOPER CONCENTRATE

This application claims the benefit of Provisional application of Ser. No. 60/234,305, filed Sep. 21, 2000.

BACKGROUND OF THE INVENTION

A. Field of the Invention

The present invention relates to a single-part, single-phase, liquid color developer concentrate for use in color photographic development and a method for processing image-wise exposed photographic color silver halide emulsions using the color developer concentrate.

B. Description of the Related Art

Exposed photographic color silver halide emulsions are generally processed through the steps of color development, desilvering, washing and stabilization, usually using the following processing solutions: color developer, bleaching solution, fixer (or a combined bleach-fixing solution), wash water and/or stabilizing solution. These processing solutions are available as diluted, single-part, ready-to-use solutions, or are prepared either from solid chemicals or sets of multiple liquid concentrates, which must be mixed and diluted prior to use.

For the developer processing step, sets of multiple liquid concentrates have been used to prepare the color developer replenisher and working strength developer. These sets of multiple liquid concentrates have been required in order to separate individual components necessary to form the color developer composition to avoid unwanted chemical reactions between these components, wherein the chemical reactions cause deterioration of the developer concentrate during long term storage. The sets of multiple liquid concentrates have found wide-reaching commercial success within the photographic processing industry. However, mixing and diluting multiple concentrates to form a single developer processing solution requires a specific addition order of the concentrates and dilution water. Improper addition order may cause severe precipitation of the active ingredients, compromising the performance of the solution and causing mechanical malfunction of the processor.

Therefore, there is a need in the color photographic processing industry to combine the multiple liquid concentrates into a single-part concentrate in order to simplify the preparation of working solutions and replenisher solutions, minimize the chance of mixing error, and reduce packaging waste. At the same time, the long-term stability of the liquid concentrate compositions must be maintained.

For color photographic processing, one or more p-phenylenediamine or a derivative or salt thereof (hereinafter "p-phenylenediamine") is required in the color developing composition to function as a color developing agent. To stabilize the p-phenylenediamine, preservatives of hydroxylamine or a derivative thereof (hereinafter "hydroxylamine") are required. However, p-phenylenediamine and hydroxylamine react in liquid form in aqueous solutions. Further, p-phenylenediamine is not very soluble at the high pH levels required for color photographic processing. Thus, incorporation of these chemicals into a single aqueous solution that is stable and simple to manufacture has not heretofore been possible.

It is recognized that these disadvantageous chemical reactions are unique to the color photographic processing industry. Black and white photographic processing single-part concentrate solutions are known, such as, for example, U.S. Pat. No. 5,376,510 to Parker et al. and U.S. Pat. No. 4,987,060 to Marchesano, as well as many commercially available products and compositions. However, since color developing compositions are different from black and white developing compositions, there is still a need in the industry to produce a single-part liquid color developer concentrate useful in forming color developer replenishers and color working strength developers. Thus, numerous investigations have been made in the industry directed toward developing single-part color developer concentrates.

Papai (U.S. Pat. No. 5,891,609) teaches a heterogeneous, single-part color developer concentrate having distinct layers or phases: an aqueous lower phase, an upper phase containing p-phenylenediamine developing agent dissolved in an organic solvent of single ring heterocyclic amide, and an optional middle phase consisting of solid particles suspended between the other two layers. Such a heterogeneous product is disadvantageous because use of only a portion of the contents of the container can result in an uneven dosage of the active ingredients, thus affecting the consistency of the developer performance. Additionally, residue remaining in the developer concentrate container upon dispensing and mixing the product can result in an uneven dosage of the active ingredients. Thus, a single-phase developer concentrate is desirable.

Tappe et al (U.S. Pat. No. 6,251,573) teach a single-part color developer concentrate which comprises at least two phases. While being free of any residue or precipitation, it still retains the disadvantages of being non-homogeneous with the concomitant lack of uniformity when using only a portion of the concentrate when dosing for replenishment.

Kim et al (U.S. Pat. No. 5,914,221) teach a single-part color photographic processing composition in slurry form, with a water content of less than 50% (w/w). While providing a substantial advantage in product uniformity and high compactness, further conveniences in use and manufacturing simplification are desirable.

Hashimoto et al (EP 800111) teaches a low viscosity, pourable, slurry-form, single-part color photographic developer containing 0.1 to 10% of a water soluble polymer and 50 to 250% water based on the weight of the solid ingredients. It is taught that the slurry is easily transferred and readily dispersible. However, the slurry requires high quantities of alkali compounds in order to solubilize the p-phenylenediamine developing agent in the high water content medium and to make a developer replenisher having a pH 12.0 or greater on dilution and dissolution.

Darmon et al (U.S. Pat. Nos. 6,017,687 and 6,077,651) teaches the use of a p-phenylenediamine developing agent in free-base form. The developing agent is dissolved in an organic solvent dominated medium to form a highly compact, single-part, single-phase, liquid developer concentrate having a weight ratio of water to organic solvent of 15:85 to 50:50. However, to obtain the single-phase, liquid developer concentrate, additional manufacturing steps of in-process filtration and washing are necessary for elimination of inorganic salts formed during the dissolution of the developing agent. These inorganic salts have a low solubility in the organic solvent and thus form a precipitate which must be removed during manufacture of the developer concentrate. In addition, the high level of organic solvent in the developer concentrate may have a deleterious effect on the sensitometric performance of some color photographic emulsions, resulting in undesirable image quality. Further, the high level of organic solvents in the concentrate creates an undesirable environmental impact.

Darmon et al (U.S. Pat. No. 6,228,567) requires the use of the p-phenylenediamine color developing agent in free base form only, including the additional manufacturing steps of precipitating and washing to remove inorganic salts form the commercially available salts of color developing agents.

As seen from the review of the state of the art, use of high levels of organic solvent enables dissolution of p-phenylenediamine, but hinders dissolution of various salts necessary or desirable for use in a developer concentrate. Further, high levels of organic solvent can have a deleterious effect on the sensitometric performance of some color photographic emulsions, resulting in undesirable image quality. Again, the additional manufacturing steps of precipitation and washing to remove inorganic salts from the commercially available salts of color developing agents contribute to the difficulty in producing a single-part, single-phase color developer concentrate.

Thus, there is a continuing need in the industry to provide a homogeneous single-part color developer concentrate that is stable, simple to dilute and mix, easy to manufacture, does not compromise photographic performance, and which has minimal environmental impact, such as being used at lower replenishment rates, thereby reducing the discharge of waste to the environment and providing reduced chemical and biological oxygen demand.

SUMMARY OF THE INVENTION

The present invention provides a single-part, single-phase, liquid color developer concentrate for processing silver halide color photographic materials.

In another aspect, the present invention provides a single-part, single-phase, liquid color developer concentrate comprising:

a) a color developing agent comprising p-phenylenediamine or a derivative or a salt thereof;

b) an aqueous solution comprising water and at least one organic solvent of Formula (I) as follows:

(I)

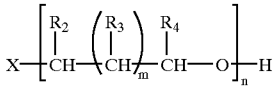

wherein X is selected from the group consisting of —$OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1, wherein the organic solvent of Formula (I) is present in the aqueous solution in an amount such that the weight ratio of water to said organic solvent is from about 60:40 to about 95:5 and wherein dissolved alkaline components and inorganic and organic alkaline salts are present in amounts such that a molar ratio of $[Na^+]/[K^+]$ is at least about 1:2 or greater in the color developer concentrate.

Preferably, the color developer concentrate further comprises dissolved alkaline components and inorganic and organic alkaline salts, preferably sodium salts, such that a molar ratio of total $[Na^+]/[K^+]$ is in the range of from about 1:1 to about 3:2, and more preferably at least about 2:1, in the liquid color developer concentrate.

In another embodiment, the present invention provides a single-part, single-phase, liquid color developer concentrate comprising:

a) a color developing agent comprising p-phenylenediamine or a derivative or a salt thereof;

b) an aqueous solution comprising water and at least one organic solvent of Formula (I) as follows:

(I)

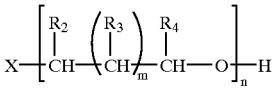

wherein X is selected from the group consisting of —$OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1, wherein a weight ratio of water to said organic solvent of Formula (I) is from about 60:40 to about 95:5, a molar ratio of the organic solvent of Formula (I) to a free base of the p-phenylenediamine or p-phenylenediamine derivative is from about 3:1 to about 30:1, and wherein dissolved alkaline components and inorganic and organic alkaline salts are present in amounts such that a molar ratio of $[Na^+]/[K^+]$ is at least about 1:2 or greater in the color developer concentrate.

In another aspect, the present invention provides a method for processing image-wise exposed photographic color silver halide emulsions, comprising the steps of:

mixing the homogeneous single-part, single-phase, liquid color developer concentrate in water so as to form a processing solution; and processing the exposed photosensitive material with said processing solution.

The single-part, single-phase, liquid color developer concentrate of the invention is a single-phase, liquid chemical composition that is simple to manufacture and has the advantages of being easy to dilute, having reduced packaging waste, having less effluent volume due to the low replenishment rate, having minimal effect on the sensitometric performance of color photographic emulsions, and having minimal environmental impact. Further, the single-part, single-phase liquid color developer concentrate of the invention offers the flexibility of using either the full content of the package of developer concentrate or only part of the package of developer concentrate to form a developer replenisher or working strength developer due to the single-phase, homogeneous nature of the developer concentrate. Other features of the present invention include effective and rapid dissolution, compactness, ease of handling and higher user productivity. Further advantages will be apparent to practitioners in the art upon review of the following detailed description.

DETAILED DESCRIPTION OF PREFERRED EMBODIMENTS

The single-part, single-phase, liquid color developer concentrate according to the present invention is prepared by combining p-phenylenediamine or a derivative or salt thereof, preferably a salt, and hydroxylamine or a derivative thereof with other photographic processing components in an aqueous solution comprising water and at least one organic solvent of Formula (I), wherein the water: organic solvent ratio is at least about 60:40 by weight and the molar ratio of $[Na^+]/[K^+]$ is at least about 1:2 or greater. Preferably, a molar ratio of the organic solvent of Formula (I) to a free base of the p-phenylenediamine or p-phenylenediamine derivative is from about 3:1 to about 30:1. The molar ratio of the organic solvent of Formula (I) to p-phenylenediamine or a derivative or salt thereof is based on the molar quantity of the free base p-phenylenediamine as known to a practitioner in the art. However, p-phenylenediamine as used in the color developer concentrate of the invention described herein may be in the form of a p-phenylenediamine free base, a p-phenylenediamine derivative or a p-phenylenediamine salt.

Preferably, the color developer concentrate comprises:

a) a color developing agent comprising p-phenylenediamine or a derivative or a salt thereof; and b) an aqueous solution comprising water and at least one organic solvent of Formula (I) in a weight ratio of at least about 60:40, wherein Formula (I) is as follows:

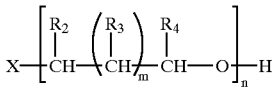

(I)

wherein X is selected from the group consisting of —$OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1, wherein a weight ratio of water to said organic solvent of Formula (I) is from about 60:40 to about 95:5, a molar ratio of the organic solvent of Formula (I) to a free base of the p-phenylenediamine or p-phenylenediamine derivative is from about 3:1 to about 30:1, and/or wherein dissolved alkaline components and inorganic and organic alkaline salts are in an amount such that the molar ratio of $[Na^+]/[K^+]$ is at least about 1:2 or greater in the color developer concentrate.

P-phenylenediamine or a derivative or salt thereof is present in a concentration of about 10.0 to 40.0 mM, preferably in a concentration of 18.0 to 30.0 mM, in a developer replenisher formed by diluting the color developer concentrate in water by a volume factor of about 2 to about 17, preferably about 2 to about 10. Preferably, p-phenylenediamine or a derivative or salt thereof is present in an amount such that a molar ratio of the organic solvent of Formula (I) to a free base of the p-phenylenediamine, or p-phenylenediamine derivative is from about 3:1 to about 30:1.

It is preferred to use a salt of p-phenylenediamine because salts of p-phenylenediamine are commercially available and offer greater safety in handling, including lower toxicity. Further, when a salt of p-phenylenediamine is used, the need for in-process filtration and washing steps is eliminated. This eases manufacturing by removing the need for additional equipment and lowering the production cost to prepare the color developer concentrate.

Suitable derivatives and salts of p-phenylenediamine include, but are not limited to, for example:

4-amino-3-methyl-N-ethyl-N((beta)-(methanesulfonamido)ethyl) aniline,

N,N-diethyl-p-phenylenediamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine, 4-amino-3-methyl-N,N-diethylaniline, 4-amino-3-methyl-N-ethyl-N-(3-hydroxypropyl)aniline, 4-amino-N-ethyl-N-(2-hydroxyethyl)aniline, 4-amino-3-methyl-N-ethyl-N-(2-hydroxyethyl)aniline, 4-amino-3-methyl-N-ethyl-N-(2-methanesulfonamidoethyl)aniline, N-(2-amino-5-N, N-diethylaminophenylethyl) methanesulfonamide, N,N-dimethyl-p-phenylenediamine, 4-amino-3-methyl-N-ethyl-N-(2-methoxyethyl)aniline, 4-amino-3-methyl-N-ethyl-N-(4-hydroxybutyl)aniline, 4-amino-3-methyl-N-ethyl-N-(2-butoxyethyl)aniline, and the like, and salts thereof. A preferred salt is 4-(N-ethyl-N-2-methanesulfonylaminoethyl)-2-methylphenylene diamine sesquisulfate. Other suitable salts and derivatives of p-phenylenediamine are known to practitioners in the art.

Hydroxylamines and derivatives or salts thereof for use in the color developer concentrate as a preservative and/or antioxidant are of the following general Formula (IV):

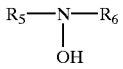

(IV)

wherein $R_5$ and $R_6$ each are independently selected from a hydrogen atom, substituted or unsubstituted alkyl group, substituted or unsubstituted alkenyl group, substituted or unsubstituted aryl group or substituted or unsubstituted heteroaromatic group, with the proviso that both $R_5$ and $R_6$ cannot be hydrogen atoms at the same time. Alternately, $R_5$ and $R_6$, taken together, may form a heterocyclic ring with the nitrogen atom. The heterocyclic structure is typically a 5- or 6-membered ring constructed of carbon, hydrogen, halogen, oxygen, nitrogen and/or sulfur atoms, and may be either saturated or unsaturated. Most often, $R_5$ and $R_6$ are independently selected from alkyl or alkenyl groups preferably having 1 to 10 carbon atoms, most preferably 1 to 5 carbon atoms. The nitrogenous heterocyclic rings formed by $R_5$ and $R_6$ taken together include, but are not limited to, piperidyl, pyrrolidinyl, N-alkylpiperazyl, morpholyl, indolinyl, and benzotriazole groups, for example. Illustrative, non-limiting examples of the compounds of Formula (IV) are given below.

IV-1 $C_2H_5—N(OH)—C_2H_5$

IV-2 $CH_3OC_2H_4—N(OH)—C_2H_4—OCH_3$

IV-3 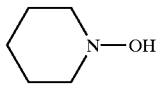

IV-4 $C_2H_5—NH(OH)$

IV-5 $HO—N(CH_2CO_2H)_2$

IV-6 $HO—N(CH_2CH_2CO_2H)_2$

IV-7 $HO—N(CH_2CH_2SO_3H)_2$

IV-8 $HO—N(CH_2—CH(OH)—CH_2—SO_3H)_2$

IV-9 $HO—N(CH_2PO_3H_2)_2$

IV-10 $HO—N(CH_2CH_2CH_2PO_3H_2)_2$

IV-11 $HO—N(CH_2CH_2OH)_2$

IV-12 $HO—NH—CH_2CO_2H$

IV-13 $HO—NH—CH_2CH_2SO_3H$

IV-14 $HO—NH—CH_2PO_3H$

IV-15 $HO—NH—CH_2CH_2OH$

IV-16 $HO—N(CH_2CH_2SO_3H)(CH_3)$

IV-17 $HO—N(CH_2CO_2H)(C_2H_5)$

-continued

IV-18 $HO—N(CH_2CH_2SO_3H)(CH_2CO_2H)$

IV-19 $HO—N(CH_2CO_2H)(CH_3)$

IV-20 $HO—N(CH_2CH_2SO_3H)(CH_2CH_2CO_2H)$

The compounds of Formula (IV) may be used alone or in an admixture of two or more. The compounds of Formula (IV) are preferably added to the working strength developer and developer replenisher in an amount of about 5 to 150 mM, more preferably in an amount of about 10 to 100 mM. The addition of alkanolamines such as hydroxylamine-N, N'-diethanesulfonic acid or diethylhydroxylamine, or derivatives or salts thereof, is especially preferred.

The presence of water in amounts of from about 60% to about 95% by weight of the solution system in the color developer concentrate enables easy mixing and solubility of all components within the color developer concentrate. Herein, the "solution system" is defined as the total quantity of both water and organic solvents. Preferably, water is present in the color developer concentrate in an amount of at least about 70%, preferably at least about 75%, more preferably at least about 80% and most preferably at least about 90%, by weight of the solution system in the color developer concentrate.

The organic solvent has a composition as shown in Formula I below and is present in an amount of from about 5% to about 40% by weight of the solution system in the color developer concentrate. Preferably, the organic solvent of Formula I is present in an amount of about 30% or less, preferably 25% or less, more preferably 20% or less, and most preferably 10% or less of the solution system. Use of the organic solvent of Formula I in amounts of 40% or less by weight of the solution system in the color developer concentrate has several advantages. For example, it is known that the presence of organic solvents in the developer replenisher or working strength developer may result in undesirable photographic performance effects such as poor image quality on some photographic color silver halide emulsions. This effect is minimized as the amount of organic solvent is reduced. Further, use of lower amounts of organic solvent reduces chemical cost and reduces the total biochemical oxygen demand of the processing effluent.

The organic solvent of Formula (I) has the following composition:

$$X-\left[CH(R_2)-\left(CH(R_3)\right)_m-CH(R_4)-O\right]_n-H \quad (I)$$

wherein X is selected from the group consisting of $—OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1. The compound of Formula (1) has a molecular weight of about 1,000 or less, preferably less then about 500.

Compounds of Formula (I) enhance the solubility of p-phenylenediamine or a derivative or salt thereof in the color developer concentrate and demonstrate substantial miscibility with water as evidenced by forming a clear solution, free from turbidity and phase separation. This enables formation of a single-part, single-phase, liquid color developer concentrate according to the present invention.

Preferred examples of the compound of Formula (I) include, but are not limited to, ethylene glycol, diethylene glycol, triethylene glycol, polyethylene glycol, tetraethylene glycol, propanediol, butanediol, diethylene glycol monoethyl ether, triethylene glycol monophenyl ether, and propylene glycol monomethyl ether. Most preferred compounds of Formula (I) are ethylene glycol, diethylene glycol and triethylene glycol. Other compounds of Formula (I) as known to practitioners in the art may also be used.

Optionally, two or more organic solvents of Formula (I), each independently selected from Formula (II) or (III) as set forth below, may be used in combination to form the developer concentrate. Formulas (II) and (III) are defined as follows:

(II)

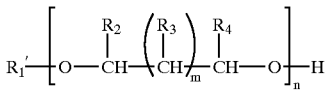

(III)

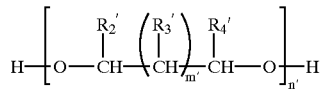

wherein $R_2$, $R_3$, $R_4$, n and m are defined as for Formula (I); $R_1'$ is acyl, alkyl of 1 to 2 carbons, alkenyl of 2 to 4 carbons, aryl, or substituted or unsubstituted heteroaromatic; $R_2'$ and $R_4'$ are the same or different and are independently selected from H, alkyl of 1 to 2 carbons, alkenyl of 2 to 4 carbons, aryl, and substituted or unsubstituted heteroaromatic; $R_3'$ is H, alkoxyl of 1 to 2 carbons, alkyl of 1 to 2 carbons, aryl, arylalkoxyl, aryloxycarbonyl and substituted or unsubstituted alkoxycarbonyl; n' is an integer of 1 to 12; and m' is 0 or 1.

Other water-soluble or water-miscible additives capable of enhancing the solubility of p-phenylenediamine or derivatives or salts thereof that are compatible with photographic development may also be added to the color developer concentrate to aid in forming a homogenous liquid color developer concentrate. Photographic compatibility herein means providing acceptable sensitometric performance and avoiding dye diffusion, accelerated image fading, edge-penetration of developer into a paper base, and the like, wherein other unacceptable effects of incompatible additives are known to practitioners in the art. Additional water-soluble additives may be present in an amount of from about 0.4 to about 40 g/L of the color developer concentrate. Suitable additives include, but are not limited to, benzyl alcohol and p-toluene sulfonic acid or its salt. Other suitable additives are known to practitioners in the art.

The weight ratio of water: organic solvent of at least about 60:40 in the solution system of the color developer concentrate ensures the formation of a single-part, single-phase, liquid color developer concentrate that is aqueous, stable, and compact, wherein the color developer concentrate will have a minimal solvent effect on photographic performance, is produced with low chemical, shipping and packaging costs, and has minimal environmental impact compared to previously known color developer concentrates. Use of a weight ratio of less than about 60:40 of water: organic solvent in the solution system of the color developer concentrate makes it difficult to achieve complete dissolution of all ingredients in the developer composition and may cause undesired photographic effects.

Herein, "a single-part, single-phase liquid" is defined to mean a mixture of two or more ingredients to form a homogenous liquid without phase separation, i.e., without showing multiple liquid layers, solid precipitation, turbidity or haziness of the final liquid mixture. Thus, the single-part, single-phase, liquid color developer concentrate of the invention is meant to be substantially free of solid particles.

To produce a color developer concentrate with increased solubility and compactness, potassium salts are known in the art as exemplified in Papai, U.S. Pat. No. 5,891,609, and Darmon et al, U.S. Pat. Nos. 6,017,687, 6,077,651, and 6,228,567, incorporated herein by reference. As demonstrated in the examples of these patents, and as known to practitioners in the art, it is preferred to maintain potassium as the predominate cation in color developer concentrates.

However, the inventors herein have surprisingly discovered that in order to achieve a highly compact, single-part, single-phase, liquid color developer concentrate using a mixture of water and organic solvent as the solution system, the ratio of $[Na^+]/[K^+]$ must be significantly increased in order to enhance the salt solubility. In particular, the molar ratio of $[Na^+]/[K^+]$ is desirably at least about 1:2 or greater, more preferably in a range of from about 1:1 to about 3:2, and most preferably at least about 2:1 or greater. The sodium and potassium ions are those supplied by a mixture of sodium and potassium salts that are present in the color developer concentrate.

Thus, the color developer concentrate preferably comprises dissolved alkaline components and inorganic and organic alkaline, in particular sodium salts, such as, but not limited to, NaOH and $Na_2CO_3$, in an amount such that the molar ratio of total $[Na^+]/[K^+]$ in the developer concentrate composition is at least about 1:2 or greater, more preferably in a range of from about 1:1 to 3:2, and most preferably at least about 2:1 or greater.

The amount of the alkaline components is adjusted as known to practitioners in the art to provide a color developer concentrate having a pH range of from about 11 to about 13. The developer replenisher formed by diluting the color developer concentrate in water at a volume factor of about 2 to about 17 has a pH of about 10.0 to about 12.5, preferably 10.5 to 12.5. The working strength developer formed by diluting the color developer concentrate in water at a volume factor of about 2 to about 17 has a pH of about 9.0 to about 10.5.

Other developer components as known to practitioners in the art also may be added to the color developer concentrate. For example, one or more buffering agents may be present in the color developer concentrate in order to maintain the pH of the developer replenisher and working strength developer at desirable levels upon dilution of the color developer concentrate. Suitable buffering agents include, but are not limited to, inorganic alkali metal hydroxides, alkali metal carbonates, and the like. Alkali metal hydroxides desirably include lithium, sodium and potassium hydroxide. Alkali metal carbonates desirably include lithium, sodium and potassium carbonates. Other suitable buffering agents are known to practitioners in the art. The buffering agent may be present in the developer replenisher in an amount of from about 0.1 to 0.3 M of developer replenisher, preferably in an amount of from about 0.15 to 0.2 M of developer replenisher, though other suitable amounts outside these ranges may also be used, as known to practitioners in the art.

Other inorganic or organic antioxidants besides hydroxylamine or derivatives or salts thereof can be added to the color developer concentrate as preservatives to protect the color developing agent. The term "organic preservative" as used herein encompasses all organic compounds which when added to processing solutions for color photographic photosensitive materials function to inhibit degradation of p-phenylenediamine or derivatives or salts thereof. Specifically, a preservative as used herein prevents oxidation of p-phenylenediamine or a derivative or salt thereof by air (aerial oxidation). Especially effective organic preservatives include, but are not limited to, hydroxamic acids, hydrazines, hydrazides, phenols, (alpha)-hydroxyketones, (alpha)-aminoketones, saccharides, monoamines, diamines, polyamines, quaternary ammonium salts, nitrosyl radicals, alcohols, oximes, diamides and fused ring type amines. These preservatives are disclosed in U.S. Pat. Nos. 2,494,903; 3,615,503; 4,155,764; 4,801,521; and 5,063,142. Other useful preservatives are known to practitioners in the art and may include, but are not limited to, metals as disclosed in U.S. Pat. No. 4,330,616; salicylic acids as disclosed in JP-A 180588/1984; amines as disclosed in U.S. Pat. Nos. 4,798,783 and 5,250,396; polyethylene imines as disclosed in U.S. Pat. No. 4,252,892; and aromatic polyhydroxy compounds as disclosed in U.S. Pat. No. 3,746,544. All patents referred to are incorporated herein in their entirety by reference.

Inorganic preservatives as known to practitioners in the art may be added to the working strength developer and developer replenisher in addition to one or more organic preservatives as described herein. The inorganic preservatives may be present in an amount from about 0.4 to about 8 mM of the developer replenisher, preferably in an amount of from about 0.8 to about 2 mM of the developer replenisher.

The single-part, single-phase, liquid color developer concentrate of the present invention may further contain other developer components known to practitioners in the art such as, but not limited to, various chelating agents as precipitation inhibitors of calcium or magnesium, or as stability improving agents of the developer. Examples thereof include, but are not limited to, nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamine-o-hydroxyphenylacetic acid, 2-phosphonobutane-1,2,4-tricarboxylic acid, 1-hydroxyethylidene-1,1-diphosphonic acid, N,N'-bis(2-hydroxybenzyl)ethylenediamine-N,N'-diacetic acid and 1,2-dihydroxybenzene-4,6-disulfonic acid. These chelating agents may be used in combinations of two or more, if desired. The amount of chelating agent present in the color developer concentrate should be sufficient to sequester Group II and transition metal ions in the dilution water used to prepare the developer replenisher or working strength developer. For example, the color developer concentrate may contain chelating agents in an amount of from about 0.1 to about 10 g/L of the color developer concentrate, depending on the hardness of the dilution water. Lesser or greater amounts may also be appropriate, as determinable by practitioners in the art.

One or more optical brightening agents as known to practitioners in the art can also be added to the color developer concentrate, if necessary, in an amount of from about 0.1 to about 10 g/L, preferably from about 0.3 to about 5 g/L, of the color developer concentrate, although lesser or greater amounts may also be used as appropriate, as determinable by practitioners in the art. Preferred brighteners include 4,4'-diamino-2,2'-disulfostilbene compounds, although other suitable brighteners will be apparent to practitioners in the art. Compounds of the following general Formula (V) are especially preferred in the developer composition:

(V)

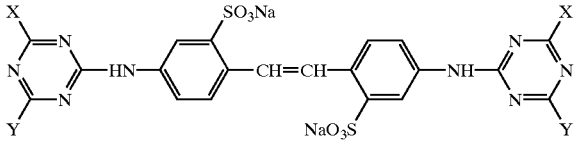

wherein X and Y may be the same or different, and are selected from the following:

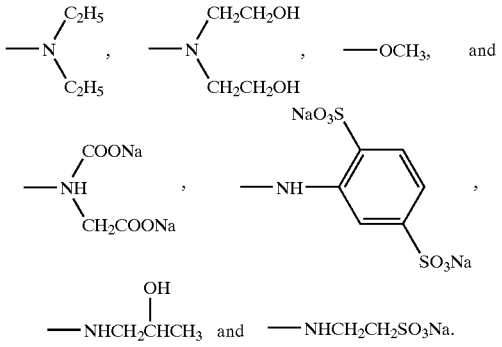

Brightening agents that can be used in combination with a compound of Formula (V) may be selected from commercially available diaminostilbene brighteners. Such commercially available diaminostilbene compounds are described, for example, in *Dyeing Note*, 19th Ed., Senshoku-sha, pp. 165–168; T. Ruble, *Optical Brighteners*, Noyes Data Corp., (1972); and *Handbook Textilhilfsmittel*, (1977) pp. 645–66, which are incorporated herein by reference. Other suitable brightening agents are known to practitioners in the art.

Other additives such as antifoggants, alkanolamines, development accelerators, development restrainers, wetting agents, fragrances and surfactants, for example, as would be readily known to practitioners in the art, can optionally be included in the color developer concentrate. A detailed description of various color developer concentrate compositions and methods of processing such compositions is given, for example, in Research Disclosure 38 957 of September 1996, published by Industrial Opportunities Ltd., Homewell Havant, Hampshire, Great Britain, and *Modern Photographic Processing*, by Grant Haist, John Wiley and Sons, 1973, Volumes 1 and 2, herein incorporated by reference. Amounts of each additive suitable for use in the color developer concentrate of the invention are readily determinable by practitioners in the art.

Conventional packages or containers as known to practitioners in the art, for example, polyethylene and other plastic bottles, may be used for packaging the single-part, single-phase, liquid color developer concentrate after preparation thereof. Suitable packages and containers and methods of packaging the color developer concentrate in such packages and containers are known to practitioners in the art.

The color developer concentrate of the invention is used after dilution in water by a volume factor of about 2 to about 17 to form a working strength developer or a developer replenisher. The developer replenisher is normally continually added to the working strength developer tank in the photographic processor to maintain developer effectiveness as the working strength developer becomes exhausted with continued use, evaporates, becomes contaminated with emulsion extractives during processing or is oxidized, such as by oxygen in the air. The usable range of replenishment rate is from about 40 ml/$m^2$ to about 110 ml/$m^2$ of processed silver halide photosensitive material, depending on various factors as described above and known to practitioners in the art. More preferably, the replenishment rate is from about 45 mil/$m^2$ to about 75 ml/$m^2$ of processed silver halide photosensitive material using the color developer concentrate of the invention as described herein.

After diluting the color developer concentrate in water by a volume factor of about 2 to about 17, the diluted color developer concentrate provides a working strength developer with a pH range of about 9.0 to about 10.5, or a developer replenisher with a pH range of about 10.0 to about 13.0, preferably from about 10.5 to about 12.5.

Another feature of the invention is to provide a method for processing an image-wise exposed photographic color silver halide emulsion. The method includes mixing the color developer concentrate with water to form a working strength developer, and processing the exposed photosensitive material with the working strength developer. While optional processing parameters are known to practitioners in the art, preferably the process is carried out for about 20–90 seconds at a temperature of from about 30–45° C.

Use of the above process with the color developer concentrate of the invention for developing image-wise exposed photographic color silver halide emulsions avoids the possibility of mixing errors inherent in using conventional sets of multiple liquid concentrates which must be mixed in a specific addition order prior to use. In the process of the invention, the color developer concentrate may be added manually to the developer replenisher tank containing dilution water by pouring at prescribed intervals, or it can be metered into the developer replenisher tank containing dilution water based on the actual quantity of photographic material processed, or based on some measured property of the process bath such as, for example, the specific gravity or pH of the working tank solution, the concentration of depleted components therein as determined by chemical analysis, the accumulation of decomposition products, the accumulation of extracts from the photographic material, other properties known to practitioners in the art, or any combination of the foregoing.

As compared with prior art single-part liquid concentrate compositions, the invention is characterized by ease in pouring, ease of mixing with water and the elimination of viscous or gummy matter that is difficult to solubilize and/or may adhere to photographic material. These attributes ensure good quality in the photographic materials processed. Further, as compared with the prior art, the single-part, single-phase, liquid color developer concentrate according to the present invention is simple to manufacture, requiring no in-process filtration or precipitate washing procedure. Further, by the use of organic solvents in an amount of less than or equal to about 40% by weight of the solution system in the color developer concentrate, the potential effect of organic solvent on the sensitometric character of various color photographic papers is minimized, chemical costs are lowered, and the environmental impact is lessened.

Additionally, with respect to the preparation of the processing solution using the color developer concentrate of the invention, handling is simplified and productivity is high because the possibility of mixing error is substantially reduced. As compared with a ready-to-use solution, the color developer concentrate of the invention has significantly reduced volume and weight, contributing to savings in transportation cost and storage space. Because there is only one container, the amount of packaging material is reduced, providing advantages of economy, lower recycling burden and enhancing environmental protection.

Other advantages of the invention will be apparent to practitioners in the art upon review of the above description and following examples.

EXAMPLES

Examples of the present invention are set forth below. These examples are set forth by way of illustration only and the invention is not limited thereto.

Abbreviations used in the examples are set forth below. Any abbreviations not set forth are given their usual meaning in the art unless expressly defined otherwise herein.

| | |
|---|---|
| CD3 = | 4-(N-ethyl-N-2-methanesulfonylaminoethyl)-2-methylphenylene diamine sesquisulfate |
| DEG = | diethylene glycol |
| DEHA = | diethylhydroxylamine |
| EDTA-$Na_2$ = | disodium ethylenediaminetetraacetic acid |
| HADS = | hydroxylamine N,N'-diethanesulfonate |
| $K_2SO_4$ = | potassium sulfate |
| $K_2CO_3$ = | potassium carbonate |
| KOH = | potassium hydroxide |
| NaBr = | sodium bromide |
| NaCl = | sodium chloride |
| $Na_2CO_3$ = | sodium carbonate |
| $Na_2SO_3$ = | sodium sulfite |
| $Na_2SO_4$ = | sodium sulfate |

Example I

The following example demonstrates the enhancement of CD3 (a salt of a p-phenylenediamine derivative) solubility in a single-part, single-phase liquid color developer concentrate when an organic solvent as defined herein is introduced as part of the solvent system of the color developer concentrate in the proper amount. In this example, diethylene glycol (DEG) was used as the organic solvent. However, practitioners in the art will recognize that other organic solvents of a similar nature or a combination of such organic solvents will yield a similar conclusion.

An exemplary composition of single-part, single-phase liquid color developer concentrate is prepared by mixing the following ingredients one by one in the listed order in a 1000 ml beaker with effective agitation.

| Model composition of single-part developer concentrate | |
|---|---|
| Water | vary to achieve the ratio in Table I |
| KOH, 45% | 20 g |

-continued

| Model composition of single-part developer concentrate | |
|---|---|
| $Na_2SO_3$ | 0.1 g |
| DEG | vary to achieve the ratio in Table I |
| DEHA | 3 g |
| CD3 | 12 g |
| Whitening agent (formula V) | 1 g |
| $Na_2CO_3$ $H_2O$ | 23 g |
| Additional Water/DEG mixture (ratio in Table I) | vary to just dissolve all solids |

The above composition of single-part, single-phase liquid color developer concentrate was made with solvent systems of three different water/DEG ratios as shown in Table I. The corresponding organic solvent/CD3 molar ratios are also listed. The final volume of each solution was achieved and recorded as the minimum solution volume in Table I by slowly adding the water/DEG mixture at the given ratio as shown in Table I until all solid ingredients in the solution were just dissolved to achieve a clear solution. The $[Na^+]$:$[K^+]$ ratio was held constant at greater than 1:2.

TABLE I

The Effect of DEG on the Solubility of CD3

| Test # | Water/DEG Ratio (weight) | DEG/CD3 Ratio (molar) | Min. Solution Volume (ml) | Comment |
|---|---|---|---|---|
| 1 | 100:0 | 0 | ~784 | Comparison |
| 2 | 83:17 | 19.3 | ~347 | Invention |
| 3 | 77:23 | 15.2 | ~206 | Invention |
| 4 | 50:50 | — | >1000 | Comparison |

The data in Table I demonstrates that by adding the proper amount of organic solvent (in this case, DEG) while maintaining the Na:K ratio greater than 1:2, the minimum volume of the single-part, single-phase liquid color developer concentrate of the invention can be significantly reduced due to the increase in solubility of the developing agent (CD3). Through the example of Test #4, it is also demonstrated that the solution can be negatively affected if the amount of organic solvent exceeds the range defined by this invention.

Example II

Example I demonstrates the desirability of using proper ratios of water to an organic solvent in the solution system in order to enhance the solubility of the developing agent in the color developer concentrate. Excessive amounts of organic solvent (greater than about 40% by weight of the concentrate solution) not only affect the solubility as shown in Example I, Test #4, but also negatively affect the developing activity of the working strength developer. This example demonstrates that large amounts of organic solvent, such as DEG, in the single-part, single-phase liquid color developer concentrate significantly reduce the developing activity of the working strength developer.

A simulated seasoned working strength developer was prepared with varying amounts of DEG, as shown in Table II where Test #5 contains no DEG as a reference. The ingredients were mixed one by one in the order listed in a 1000 ml beaker with effective agitation. A commercial Kodak RA-4 control strip was developed in each solution via a leedal tank process under standard conditions (45 sec. developing and bleach-fixing, and 90 sec. rinse, all at 380° C.). After drying, the Low Density (LD) area of each control strip was read using an X-Rite Densitometer (model 310). The LD reading of each control strip was then compared against the LD reading of the strip processed in the reference solution, Test #5, and the LD differences in activity loss, ΔLD, (representing activity loss) were recorded in Table III.

TABLE II

Composition of a Simulated Seasoned Working Strength Developer

| Ingredients | Common Part | Simulated Seasoned Working Strength Developer Composition (g) | | | | |
|---|---|---|---|---|---|---|
| Water | | 800 | | | | |
| NaBr | | 0.011 | | | | |
| NaCl | | 4.7 | | | | |
| KOH, 45% | | 0.6 | | | | |
| $[EDTA\text{-}Na_2].2H_2O$ | | 3.2 | | | | |
| $Na_2SO_3$ | | 0.1 | | | | |
| HADS | | 2 | | | | |
| DEHA, 85% | | 3 | | | | |
| CD3 | | 5.5 | | | | |
| $Na_2CO_3.H_2O$ | | 22 | | | | |
| DEG | Variation Part | 0 | 20 | 50 | 100 | 150 |
| KOH, 45% | | 0–3 (to adjust pH = 10.15) | | | | |
| Add Water | | Top to 1000 ml total volume | | | | |
| Test # | | 4 | 5 | 6 | 7 | 8 |

Note:
The seasoned working strength developer was simulated based on 60 $ml/m^2$ replenishment rate, ~25% Ag reduction and about one tank turnover per week processing load.

TABLE III

Sensitometric Effect of DEG in Working Strength Developer on the LD of a Kodak Control Strip

| Test # | DEG Level: DEG amount (g/L, working tank solution) | DEG Level: $H_2O$:DEG ratio (in concentrate) | Activity Loss (ΔLD): Cyan | Activity Loss (ΔLD): Magenta | Activity Loss (ΔLD): Yellow | Comment |
|---|---|---|---|---|---|---|
| 5 | 0 | 100:0 | 0 | 0 | 0 | Reference |
| 6 | 20 | 89:11 | −0.01 | 0 | −0.01 | Invention |
| 7 | 50 | 73:27 | −0.03 | −0.01 | −0.03 | Invention |
| 8 | 100 | 47:53 | *Out of Tolerance | −0.04 | Out of Tolerance | Comparison |

TABLE III-continued

| Sensitometric Effect of DEG in Working Strength Developer on the LD of a Kodak Control Strip | | | | | | |
|---|---|---|---|---|---|---|
| | DEG Level | | | | | |
| Test # | DEG amount (g/L, working tank solution) | $H_2O$:DEG ratio (in concentrate) | Activity Loss (ΔLD) Cyan | Magenta | Yellow | Comment |
| 9 | 150 | 22.5:77.5 | Out of Tolerance | Out of Tolerance | Out of Tolerance | Comparison |

*Note: Out of tolerance means that the activity loss is > 0.05 compared with the reference (Test #5).

The sensitometric data of Table III shows that the LD readings (particularly cyan and yellow LDs) of a standard Kodak RA-4 control strip were significantly depressed by the use of excessive amounts of organic solvent (DEG) in the simulated working tank solution. Thus, when the corresponding water/organic solvent ratio in the concentrate is outside the range defined by this invention (which less than or equal to about 60:40), both cyan and yellow LD-loss are beyond acceptable ranges.

Example III

This example illustrates that by increasing the $[Na^+]/[K^+]$ ratio in the single-part, single-phase liquid color developer concentrate of the invention, the solubility of other components, can be significantly increased. In this example, DEG was used as the organic solvent.

To avoid the complication of the p-phenylenediamine solubility issue and focus only on the solubility of other components necessary or desirable for a color developer concentrate, a simulated single-part, single-phase liquid color developer concentrate was formulated by directly adding potassium and/or sodium sulfate in the equivalent molar amount as those presented in Example I, that is, in the amount released from 12 g of CD3. The $[Na^+]/[K^+]$ ratio was varied by varying potassium and/or sodium sulfate and carbonate salt combinations without changing the total sulfate and carbonate molar amount. Other ingredients commonly used in a color paper developer were also included in the system, as set forth below. The ingredients were mixed in the order presented. The resulting minimum volume required to just completely dissolve all of the components at different $[Na^+]/[K^+]$ ratios is summarized in Table IV.

| Simulated Single-part Color developer concentrate (basic developer composition without developing agent) | |
|---|---|
| Water | 140 g |
| Optical Whitening Agents | 2.3 g (Formula V) |
| HADS | 10 g |
| $K_2SO_4/Na_2SO_4$ | vary to maintain $[SO_4]$ = 41 mM |
| $K_2CO_3/Na_2CO_3$ | vary to maintain $[CO_3]$ = 181 mM |
| EDTA | 3 g |
| NaOH | vary to adjust pH ~12.9 |
| Water/DEG mixture | vary, to just completely dissolve all ingredients to make a clear solution and achieve the final water/DEG ratio listed in Table IV |

TABLE IV

| The Effect of $[Na^+]/[K^+]$ Ratio on the Final Solution Volume (ml) | | | | |
|---|---|---|---|---|
| Test # | Water/DEG Ratio | $[Na^+]/[K^+]$ Ratio | Min. Solution Volume | Comment |
| 10 | 100:0 | 6.2:1 | ~364 | Comparison |
| 11 | 100:0 | 0.4:1 | ~497 | Comparison |
| 12 | 77:23 | 6.2:1 | ~217 | Invention |
| 13 | 77:23 | 0.4:1 | >800 | Comparison |
| 14 | 67:33 | 6.2:1 | ~206 | Invention |
| 15 | 67:33 | 0.4:1 | >1300 | Comparison |

Comparing the minimum solution volumes under the same water/DEG ratio but at different $[Na^+]/[K^+]$ ratios, it is observed that the high sodium ratio of the invention significantly increases the solubility of other components of the color developer composition. This effect becomes especially prominent at higher organic solvent content level (see Tests 14 and 15).

While this invention has been described with respect to particular embodiments thereof, numerous other forms and modifications of the invention will be obvious to those skilled in the art. This invention should be construed to cover all such obvious forms and modifications which are within the spirit and scope of the present invention as set forth in the appended claims.

What is claimed is:

1. A single-part, single-phase liquid color developer concentrate for processing imagewise exposed silver halide color photographic materials, comprising:

a) at least one color developing agent of p-phenylenediamine salt; and b) an aqueous solution comprising water and at least one organic solvent of Formula (I):

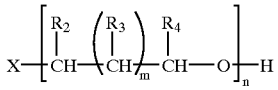

(I)

wherein X is selected from the group consisting of —$OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1;

wherein the organic solvent of Formula (I) is present in the aqueous solution in an amount such that the weight ratio of water to said organic solve is from about 60:40 to about 95:5, and wherein dissolved alkaline and inorganic and organic alkaline salts are present in amounts such that a molar ratio of $[Na^+]/[K^+]$ is at least about 1:2 or greater in the color developer concentrate.

2. The single-part, single-phase liquid color developer concentrate of claim 1, wherein the organic solvent of Formula (I) is present in the aqueous solution in an amount such that the weight ratio of water to said organic solvent is from about 75:25 to about 90:10.

3. The single-part, single-phase liquid color developer concentrate of claim 1, wherein the pH of the color developer concentrate is from about 11 to about 13.

4. The single-part, single-phase liquid color developer concentrate of claim 1, wherein dilution of the color developer concentrate with water by a volume factor of about 2 to about 17 forms a working strength developer with a pH of from about 9.0 to about 10.5, or a developer replenisher solution with a pH of from about 10.0 to about 12.5.

5. The single-part, single-phase liquid color developer concentrate of claim 1, further comprising dissolved alkaline components and inorganic and organic alkaline salts such that a molar ratio of $[Na^+]/[K^+]$ is at least about 1:1 or greater in the color developer concentrate.

6. The single-part, single-phase liquid color developer concentrate of claim 1, wherein the at least one organic solvent of Formula (I) comprises two or more organic solvents, each independently selected from the structure of Formula (II) or (III):

(II)

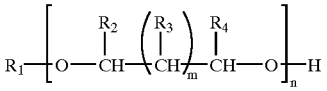

(III)

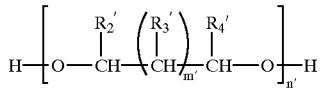

wherein $R_1$ is acyl, alkyl of 1 to 2 carbons, alkenyl of 2 to 4 carbons, aryl and substituted or unsubstituted heteroaromatic; $R_2$, $R_2'$, $R_4$ and $R_4'$ can be the same or different and are independently selected from the group consisting of H, alkyl of 1 to 2 carbons, alkenyl of 2 to 4 carbons, aryl and substituted or unsubstituted heteroaromatic; $R_3$, and $R_3'$ are independently selected from H, alkoxyl of 1 to 2 carbons, alkyl of 1 to 2 carbons, aryl, arylalkoxyl, aryloxycarbonyl and substituted or unsubstituted alkoxycarbonyl; n and n' can be the same or different and are independently selected from an integer of 1 to 12; and m and m' are the same or different and are independently selected from 1 or 1.

7. The single-part, single-phase liquid color developer concentrate of claim 1, wherein the compound of Formula (I) is selected from the group consisting of ethylene glycol, diethylene glycol, triethylene glycol, polyethylene glycol, tetraethylene glycol, propanediol, butanediol, diethylene glycol monoethyl ether, triethylene glycol monophenyl ether, and propylene glycol monomethyl ether.

8. The single-part, single-phase liquid color developer concentrate of claim 1, wherein the p-phenylenediamine salt is 4-(N-ethyl-N-2-methanesulfonylaminoethyl)-2-methylphenylene diamine sesquisulfate salt.

9. The single-part, single-phase liquid color developer concentrate of claim 1, further comprising at least one hydroxylamine preservative comprising one or more of hydroxylamine N,N'-diethanesulfonic acid or a salt thereof, or diethylhydroxylamine or a derivative or a salt thereof.

10. The single-part, single-phase liquid color developer concentrate of claim 1, further comprising at least one whitening agent selected from one or more triazinylstilbene-type compounds represented by Formula (V):

(V)

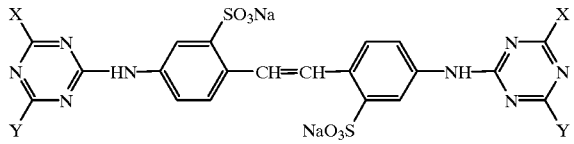

wherein X and Y may be the same or different, and are selected from the following:

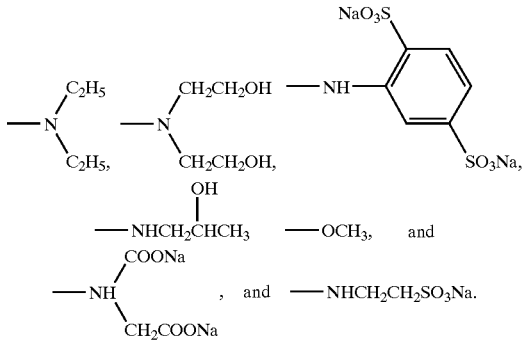

11. A single-part, single-phase liquid color developer concentrate for processing imagewise exposed silver halide color photographic materials, comprising:

a) at least one color developing agent of p-phenylenediamine salt; and b) an aqueous solution comprising water and at least one organic solvent of Formula (I):

(I)

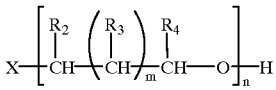

wherein X is selected from the group consisting of —$OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1;

wherein a weight ratio of water to said organic solvent of Formula (I) is from about 60:40 to about 95:5, a molar ratio of the organic solvent of Formula (I) to the p-phenylenediamine salt is from about 3:1 to about 30:1, and wherein dissolved alkaline components and inorganic and organic alkaline salts are present in amounts such that a molar ratio of $[Na^+]/[K^+]$ is at least about 1:2 or greater in the color developer concentrate.

12. The single-part, single-phase liquid color developer concentrate of claim 11, wherein the p-phenylenediamine salt is 4-(N-ethyl-N-2-methanesulfonylaminoethyl)-2-methylphenylene diamine sesquisulfate salt.

13. The single-part, single-phase liquid color developer concentrate of claim 11, wherein the organic solvent of Formula (I) is present in the aqueous solution in an amount such that the weight ratio of water to said organic solvent is from about 75:25 to about 95:5.

14. The single-part, single-phase liquid color developer concentrate of claim 11, wherein the pH of the color developer concentrate is from about 11 to about 13.

15. The single-part, single-phase liquid color developer concentrate of claim 11, wherein the molar ratio of $[Na^+]/[K^+]$ is at least about 1:1 or greater in the color developer concentrate.

16. The single-part, single-phase liquid color developer concentrate of claim 11, wherein the molar ratio of $[Na^+]/[K^+]$ is from about 1:1 to about 3:2 in the color developer concentrate.

17. The single-part, single-phase liquid color developer concentrate of claim 11, wherein the at least one organic solvent of Formula (I) comprises two or more organic solvents, each independently selected from the structure of Formula (II) or (III):

(II)

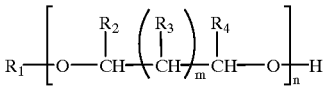

(III)

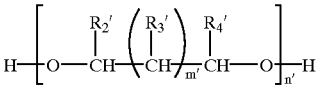

wherein $R_1$ is acyl, alkyl of 1 to 2 carbons, alkenyl of 2 to 4 carbons, aryl and substituted or unsubstituted heteroaromatic; $R_2$, $R_2'$, $R_4$ and $R_4'$ can be the same or different and are independently selected from the group consisting of H, alkyl of 1 to 2 carbons, alkenyl of 2 to 4 carbons, aryl and substituted or unsubstituted heteroaromatic; $R_3$, and $R_3'$ are independently selected from H, alkoxyl of 1 to 2 carbons, alkyl of 1 to 2 carbons, aryl, arylalkoxyl, aryloxycarbonyl and substituted or unsubstituted alkoxycarbonyl; n and n' can be the same or different and are independently selected from an integer of 1 to 12; and m and m' are the same or different and are independently selected from 0 or 1.

18. The single-part, single-phase liquid color developer concentrate of claim 11, wherein the compound of Formula (I) is selected from the group consisting of ethylene glycol, diethylene glycol, triethylene glycol, polyethylene glycol, tetraethylene glycol, propanediol, butanediol, diethylene glycol monoethyl ether, triethylene glycol monophenyl ether, and propylene glycol monomethyl ether.

19. The single-part, single-phase liquid color developer concentrate of claim 11, further comprising at least one whitening agent selected from one or more triazinylstilbene-type compounds represented by Formula (V):

(V)

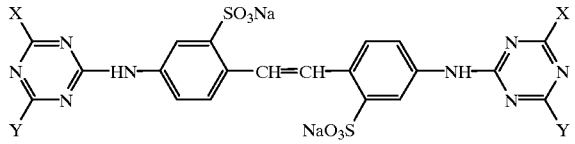

wherein X and Y may be the same or different, and are selected from the following:

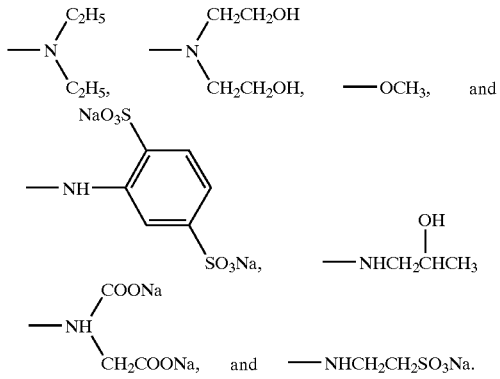

20. A method for processing image-wise exposed photographic color silver halide emulsions, comprising the steps of:

mixing the single-part, single-phase liquid color developer concentrate in water so as to form a processing solution; and processing the exposed photosensitive material with said processing solution, wherein the color developer concentrate comprises:

a) at least one color developing agent of p-phenylenediamine salt; and b) an aqueous solution comprising water and at least one organic solvent of Formula (I):

(I)

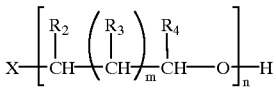

wherein X is selected from the group consisting of $—OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1;

wherein the organic solvent of Formula (I) is present in the aqueous solution in an amount such that the weight ratio of water to said organic solvent is from about 60:40 to about 95:5 and wherein dissolved alkaline components and inorganic and organic alkaline salts are present in amounts such that a molar ratio of $[Na^+]/[K^+]$ is at least about 1:2 or greater in the color developer concentrate.

21. The method of claim 20, wherein the processing solution is a developer replenisher or a working strength developer made by diluting the color developer concentrate in water by a volume factor of about 2 to about 17.

22. The method of claim 20, wherein the replenisher is replenished at a rate of from about 40 $ml/m^2$ to about 110 $ml/m^2$ of paper processed.

23. The method of claim 20, wherein the replenisher is replenished at a rate of from about 45 $ml/m^2$ to about 75 $ml/m^2$ of paper processed.

24. The method of claim 20, wherein the process is carried out for about 20 seconds to about 90 seconds in a processing temperature range of from about 30° C. to about 45° C.

25. A method for processing image-wise exposed photographic color silver halide emulsions, comprising the steps of:

mixing the single-part, single-phase liquid color developer concentrate in water so as to form a processing solution; and processing the exposed photosensitive material with said processing solution, wherein the color developer concentrate comprises:

a) at least one color developing agent of p-phenylenediamine salt; and b) an aqueous solution comprising water and at least one organic solvent of Formula (I):

(I)

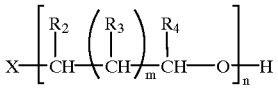

wherein X is selected from the group consisting of $—OR_1$, H and methyl; $R_1$ is selected from the group consisting of H, acyl, alkyl of 1 to 2 carbons, alkenyl of 2 to 4 carbons, aryl and substituted or unsubstituted heteroaromatic; $R_2$ and $R_4$ can be the same or different and are independently selected from the group consisting of H, alkyl of 1 to 2 carbons, alkenyl of 2 to 4 carbons, aryl and substituted or unsubstituted heteroaromatic; $R_3$ is selected from the group consisting of H, alkoxyl of 1 to 2 carbons, alkyl of 1 to 2 carbons, aryl, arylalkoxyl, aryloxycarbonyl and substituted or unsubstituted alkoxycarbonyl; n is an integer from 1 to 12; and m is 0 or 1;

wherein a weight ratio of water to said organic solvent of Formula (I) is from about 60:40 to about 95:5, a molar ratio of the organic solvent of Formula (I) to the p-phenylenediamine salt is from about 3:1 to about 30:1, and wherein dissolved alkaline components and inorganic and organic alkaline salts are in amounts such that the molar ratio of $[Na^+]/[K^+]$ is at least about 1:2 or greater in the color developer concentrate.

* * * * *